US007777559B2

(12) United States Patent
Chou

(10) Patent No.: US 7,777,559 B2
(45) Date of Patent: Aug. 17, 2010

(54) REFERENCE VOLTAGE GENERATOR FOR ANALOG-TO-DIGITAL CONVERTER CIRCUIT

(75) Inventor: Kuo-Yu Chou, Hsin-Chu Hsien (TW)

(73) Assignee: Novatek Microelectronics Corp., Hsinchu Science Park, Hsin-Chu (TW)

( * ) Notice: Subject to any disclaimer, the term of this patent is extended or adjusted under 35 U.S.C. 154(b) by 0 days.

(21) Appl. No.: 11/855,142

(22) Filed: Sep. 13, 2007

(65) Prior Publication Data

US 2008/0252364 A1 Oct. 16, 2008

(30) Foreign Application Priority Data

Apr. 12, 2007 (TW) ..... 96112831 A

(51) Int. Cl.
*G05F 1/10* (2006.01)

(52) U.S. Cl. ..... 327/541; 327/530

(58) Field of Classification Search ..... None
See application file for complete search history.

(56) References Cited

U.S. PATENT DOCUMENTS 3,619,659 A * 11/1971 Meyer et al. ..... 327/130
5,155,385 A * 10/1992 Gotoh et al. ..... 327/562
6,008,632 A * 12/1999 Sasaki ..... 323/313
6,150,852 A * 11/2000 Aparin ..... 327/103
6,522,083 B1 * 2/2003 Roach ..... 315/224
6,522,185 B2 * 2/2003 Helt et al. ..... 327/276
6,577,154 B2 * 6/2003 Fifield et al. ..... 326/30
6,636,118 B1 * 10/2003 Kusano et al. ..... 330/298
6,753,716 B2 * 6/2004 Sihm et al. ..... 327/290
2004/0178742 A1 * 9/2004 Date et al. ..... 315/169.3
2005/0068077 A1 * 3/2005 Tschanz et al. ..... 327/158
2006/0049800 A1 * 3/2006 Reed et al. ..... 320/128
2006/0087300 A1 * 4/2006 Endo et al. ..... 323/282
2006/0176096 A1 * 8/2006 Dreps et al. ..... 327/262
2006/0187108 A1 8/2006 Moon
2006/0202876 A1 9/2006 Lee

* cited by examiner

*Primary Examiner*—Cassandra Cox
(74) *Attorney, Agent, or Firm*—Winston Hsu

(57) ABSTRACT

To mitigate kickback noise effect, the present invention provides a reference voltage generator for an analog-to-digital converter circuit. The reference voltage generator includes a bias generator, a bias converter and an output unit. The bias generator is used for generating a first bias voltage in accordance with a reference voltage. The bias converter is coupled to the bias generator and is used for converting the first bias voltage to a second bias voltage. The output unit is coupled to the bias converter and used for generating a first voltage to a load circuit in accordance with the second bias voltage.

8 Claims, 6 Drawing Sheets

REFERENCE VOLTAGE GENERATOR FOR ANALOG-TO-DIGITAL CONVERTER CIRCUIT

BACKGROUND OF THE INVENTION

1. Field of the Invention

The present invention relates to an electronic device for providing reference voltages, and more particularly to a reference voltage generator that can mitigate kickback noise interference to provide a steady reference voltage for an analog-to-digital converter.

2. Description of the Prior Art

An electronic device commonly requires a reference voltage generating circuit for providing reference voltage levels to internal circuits. An ideal reference voltage generating circuit is a voltage generator that can generate a fixed voltage that does not vary with temperature, supply power variation, or kickback noise. An analog-to-digital converter (ADC) requires the reference voltage generating circuit to provide an input voltage range and converting levels. For example, a 10-bit, 20 MHz pipeline ADC generally operates with three reference voltages: 1.525V, 1.4V and 1.375V. If the reference voltage generating circuit generates reference voltages imprecisely or unstably, the ADC may convert input signals distortedly. Hence, how to make cooperation between the reference voltage generating circuit and the ADC perfect and stable over bandwidth, noise, and operation-rate dominates converting performance of the ADC.

Please refer to FIG. 1, which is a schematic diagram of a reference voltage generator 100 according to the prior art. The reference voltage generator 100 includes amplifiers 110 and 120 with unity gain and capacitors 112 and 122, and converts the reference voltages REF1 and REF2 for an ADC unit 130 through the amplifiers 110 and 120. For absorption of the high-frequency noise component, the capacitors 112 and 122 are adopted to couple to the outputs of the amplifiers 110 and 120 so that the output signals remain steady at high frequencies. However, as the operation rate of the ADC unit 130 increases, the reference voltage generator 100 requires the capacitors 112 and 122 have larger capacitance. The capacitors 112 and 122 become large, resulting in space being occupied in the reference voltage generator 100.

To solve this, US Patent Publication no. 2006/0187108, entitled 'Reference Voltage Driving Circuit and Pipeline Analog to Digital Converter Including Same', discloses a reference voltage driver including two source followers for converting reference voltages REFT and REFC to output appropriate voltages to an ADC at the back end. As can be seen from FIG. 3 of 2006/0187108, the transistor MPT2 controls a current of the transistor MPT1 via a bias voltage PBIAS, and outputs a voltage RTOP_MDAC from the drain after the reference voltage REFT is converted by the transistor MPT1. Thus, the reference voltage driver can operate at high frequency to cooperate with a high-speed ADC. However, the reference voltage REFT may be disturbed by variation of the voltage RTOP_MDAC, causing operation errors of the ADC. Hence, the reference voltage driver cannot significantly resist the feedback signal disturbance.

In addition, US Patent Publication no. 2006/0202876, entitled 'Reference Voltage Supplying Circuit and Analog-to-Digital Converter Equipped Therewith', discloses a reference voltage supplying circuit. According to 2006/0202876, the operational amplifier (OP) generates a reference voltage level, and two voltage generators then adjust the reference voltage level to output a maximum reference voltage and a minimum reference voltage to the ADC circuit. However, in the reference voltage supplying circuit, the OP cannot perfectly cooperate with the ADC circuit due to the operating bandwidth limitation. Besides, as the output signals $R_{TOP}$ and $R_{BOT}$ are disturbed by feedback noise from the ADC circuit, the reference voltage level outputted from the OP is affected as well. In this situation, the reference voltage supplying circuit demands an OP having wide operating bandwidth and great stability to solve the above-mentioned problems.

As mentioned above, the reference voltage circuit of the prior art cannot significantly resist signal disturbance from the outputs to the inputs, and has insufficient operating bandwidth or a lack of stability.

SUMMARY OF THE INVENTION

It is therefore a primary objective of the present invention to provide a reference voltage generator that can mitigate kickback noise interference from an analog-to-digital converter circuit.

The present invention discloses a reference voltage generator for an analog-to-digital converter circuit. The reference voltage generator includes a bias generator, a bias converter and an output unit. The bias generator is used for providing a first bias voltage in accordance with a reference voltage. The bias converter is coupled to the bias generator and is used for converting the first bias voltage to a second bias voltage. The output unit is coupled to the bias converter and used for generating a first voltage to a load circuit in accordance with the second bias voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
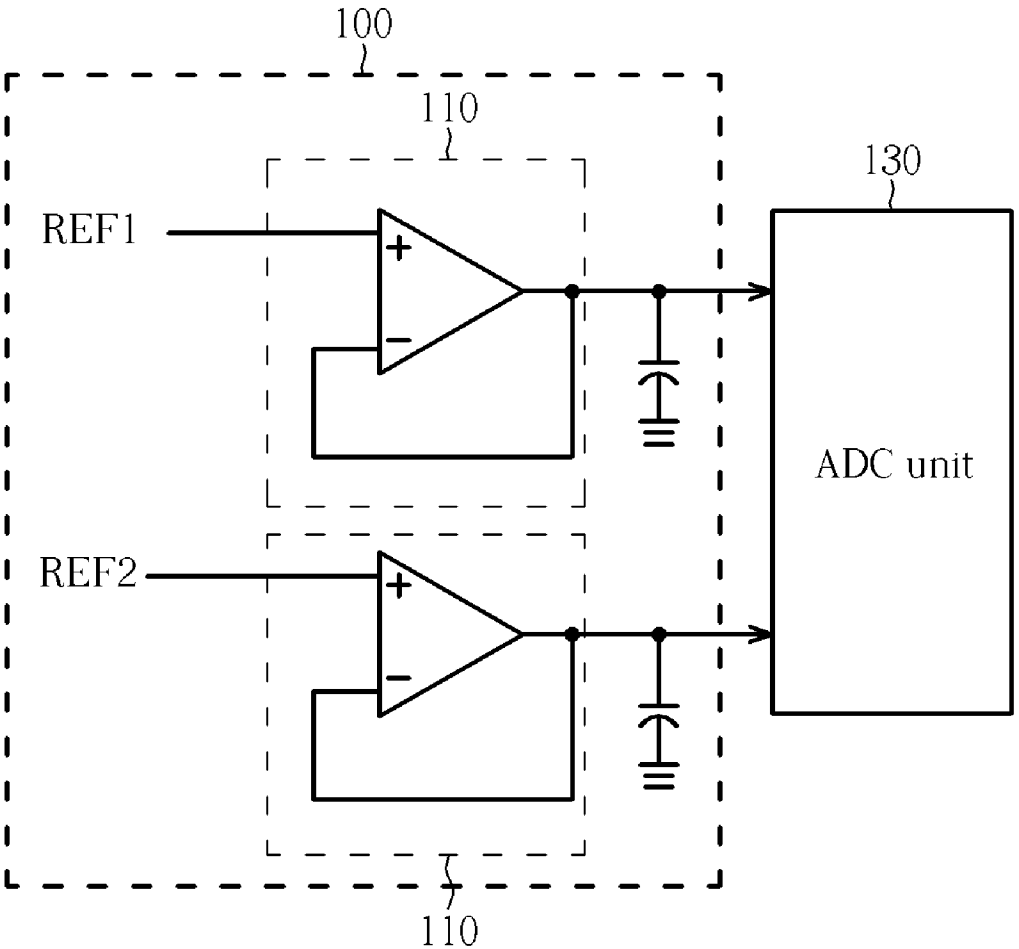
Fig. 1 Prior Art
FIG. 1 is a schematic diagram of a reference voltage generator for an ADC circuit according to the prior art.
Figure 2:
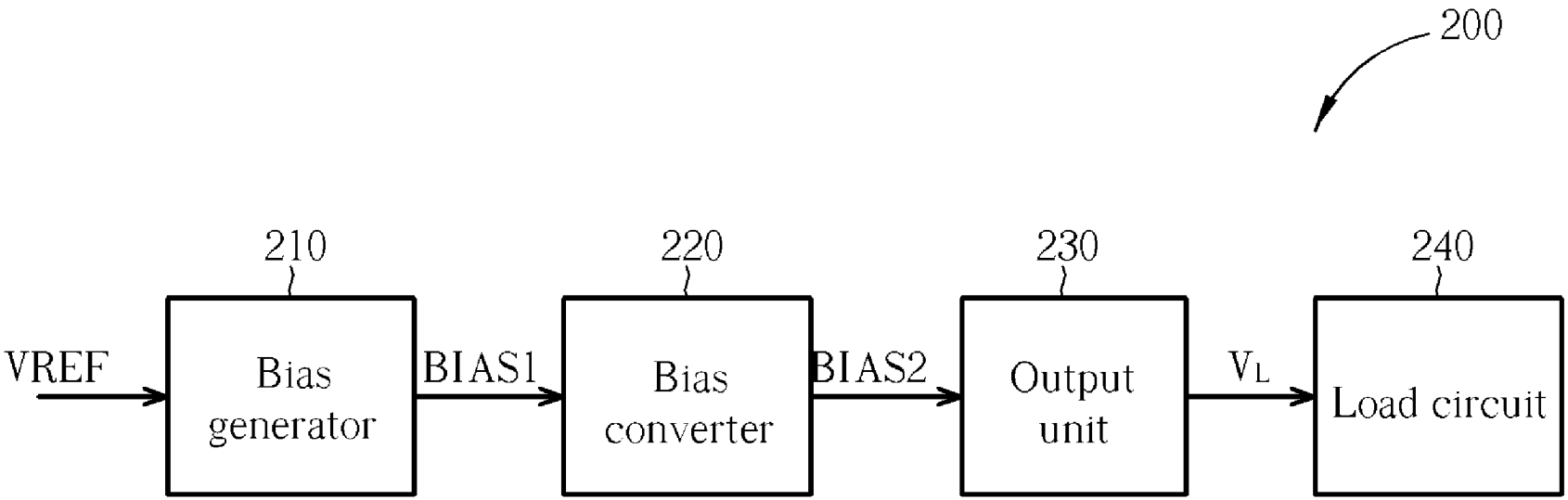
FIG. 2 is a schematic diagram of a reference voltage generator for an ADC circuit according to the present invention.

Please refer to FIG. 2, which is a schematic diagram of a reference voltage generator 200 for an analog-to-digital converter (ADC) circuit according to the present invention. The reference voltage generator 200 includes a bias generator 210, a bias converter 220 and an output unit 230. The bias generator 210 is used for generating a first bias voltage BIAS1 in accordance with a reference voltage VREF. The bias converter 220 is coupled to the bias generator 210 and is used for converting the first bias voltage BIAS1 to a second bias voltage BIAS2. The output unit 230 is coupled to the bias converter 220 and used for providing a first voltage $V_L$ to a load circuit 240 in accordance with the second bias voltage BIAS2. The load circuit 240 is preferably an ADC circuit.

In the reference voltage generator 200, the first voltage $V_L$ varies with signal variations of the load circuit 240, thereby affecting the second bias voltage BIAS2 outputted by the bias converter 220. As the second bias voltage BIAS2 is disturbed, the bias converter 220 can rapidly stabilize the second bias voltage BIAS2 before the disturbance affects the first bias voltage BIAS1. In other words, the bias converter 220 can effectively resist the signal disturbance spreading from the second bias voltage BIAS2 to the first bias voltage BIAS1, maintaining stability in the bias generator 210 and the reference voltage VREF. In other words, the reference voltage generator 200 utilizes the bias converter 220 to absorb feedback signal disturbance from the load circuit 240 or the output unit 230. Hence, the reference voltage generator 200 can consistently provide a stable reference voltage for the load circuit 240. Of course, the reference voltage generator 200 can be implemented in various circuit forms for the purpose of feedback noise resistance.

Figure 3:
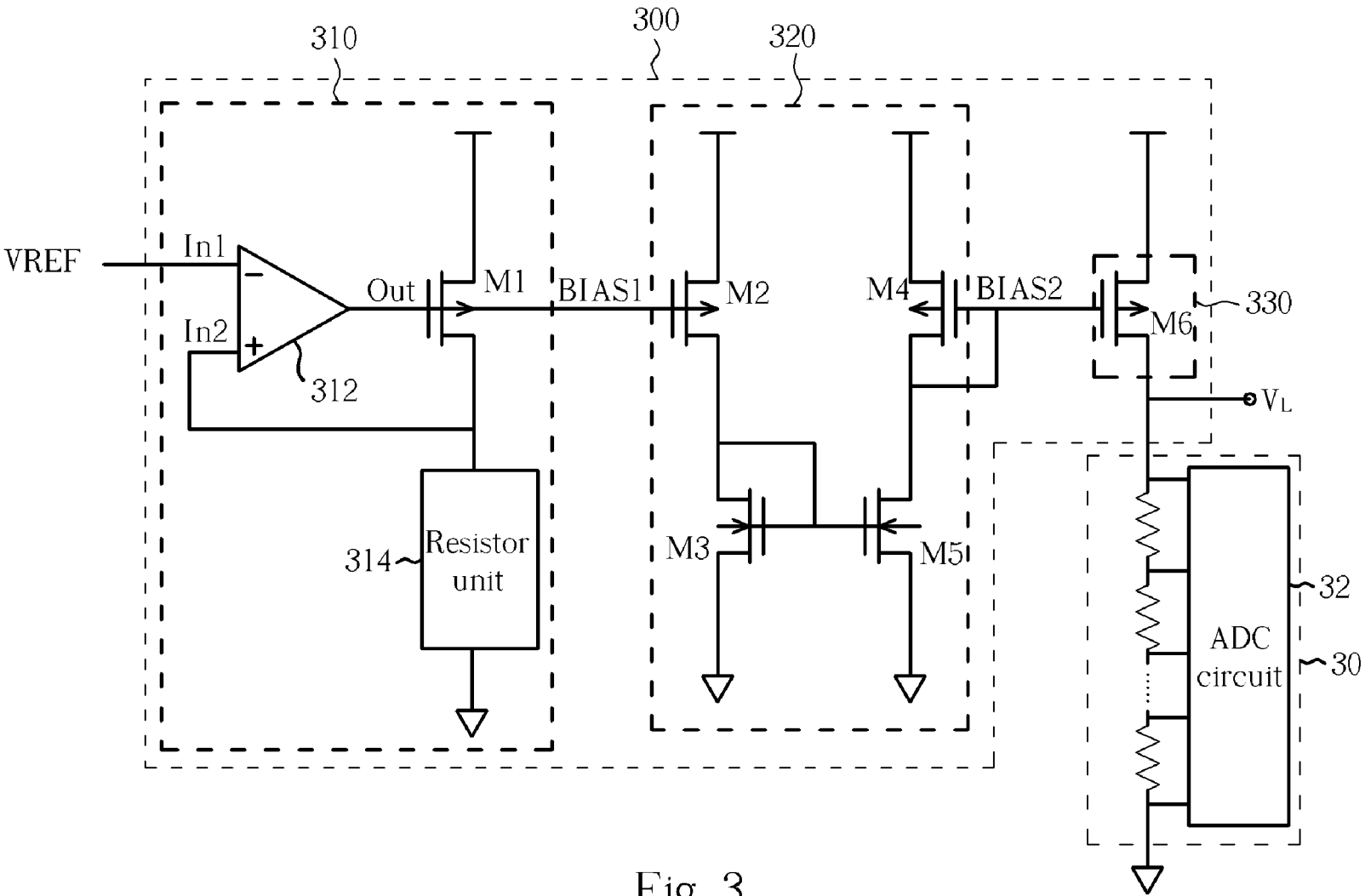
FIGS. 3-6 are schematic diagrams of reference voltage generators for an ADC circuit according to embodiments of the present invention.

For example, please refer to FIG. 3, which is a schematic diagram of a reference voltage generator 300 for an ADC circuit 32 according to an embodiment of the present invention. The reference voltage generator 300 is used for converting a reference voltage VREF into a first voltage $V_L$ for a load circuit 30, and includes a bias generator 310, a bias converter 320 and an output unit 330. The bias generator 310 includes a transistor M1, an amplifier 312 and a resistor unit 314, and is used for generating a first bias voltage BIAS1 in accordance with the reference voltage VREF. The transistor M1 is a p-type metal oxide semiconductor transistor (p-type MOSFET) and is used for providing a current for the resistor unit 314, so as to provide corresponding voltage to the amplifier 312. The amplifier 312 has input terminals In1 and In2, and an output terminal Out, and is used for outputting the first bias voltage BIAS1 to a gate of the transistor M1 and the bias converter 320 in accordance with the reference voltage VREF received by the input terminal In1. The bias converter 320 is a current mirror, and includes transistors M2-M5. The transistors M2 and M4 are p-type MOSFETs, whereas the transistors M3 and M5 are n-type MOSFETs. The operation of a current mirror should be well known in the art and the detailed description is omitted here. Hence, with the transistors M2-M5, the bias converter 320 can provide a second bias voltage BIAS2 with respect to the first bias voltage BIAS1 for the output unit 330. The output unit 330 is a transistor M6, as well a p-type MOSFET, and is used for providing the first voltage $V_L$ for the load circuit 30 in accordance with the second bias voltage BIAS2. As can be seen in FIG. 3, the load circuit 30 includes a sequence of resistors and the ADC circuit 32. The sequence of resistors forms a bias circuit for dividing the first voltage $V_L$ to provide multiple voltage levels for the ADC circuit 32. Thus, the ADC circuit 32 can convert signals from analog to digital form according to the voltage levels. In addition, the resistor number and connections in the resistor unit 314 should be the same as those in the load circuit 30.

In FIG. 3, as signal disturbance appears in the load circuit 30, the signal disturbance affects the first voltage $V_L$ and further spreads to the second bias voltage BIAS2, such that the gate voltage of the transistor M4 becomes unstable. However, a current of the branch, formed by the transistors M4 and M5, is controlled by another current of the branch, formed by the transistors M2 and M3. Thus, the transistor M4 can absorb the signal disturbance forwarded by the load circuit 30, and the branch current with respect to the transistors M2 and M3 is not affected. Therefore, the bias generator 310 and the reference voltage VREF consistently operate in a stable state.

As mentioned above, the signal disturbance occurring in the load circuit 30 may induce a kickback noise to the bias converter 320. With the transistor M4, the bias converter 320 can absorb the kickback noise, maintaining the currents of the transistors M2 and M3 in the stable state. Thus, the amplifier 312 and the reference voltage VREF of the bias generator 310 are immunized from the kickback noise, and thereby the reference voltage generator 300 can consistently provide a fixed and stable voltage for the ADC circuit 32. Moreover, the reference voltage generator 300 can employ an amplifier with a narrower bandwidth, and prevent spreading of the disturbance driven by the kickback noise.

Figure 4:
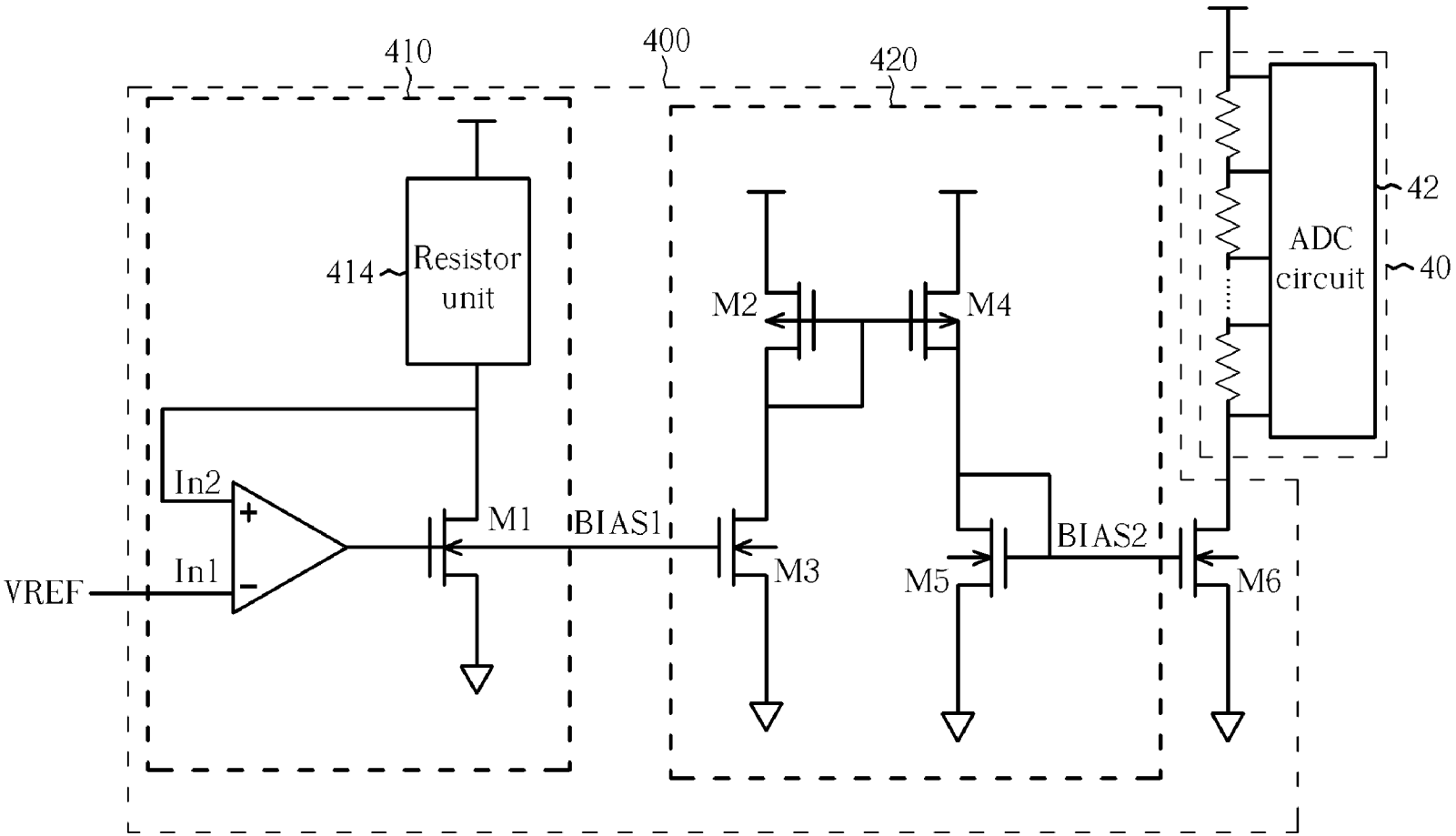
Figure 5:
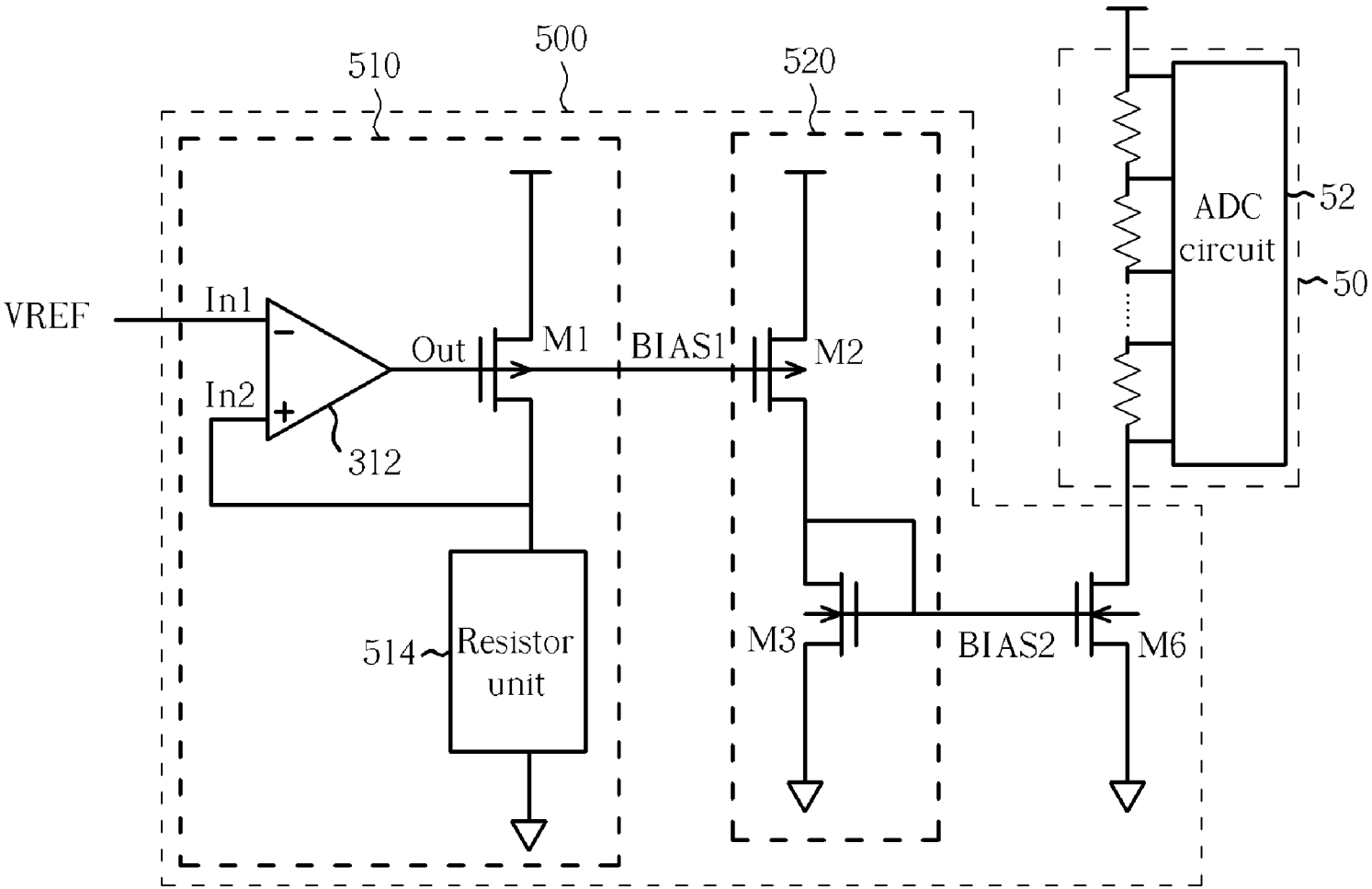
Figure 6:
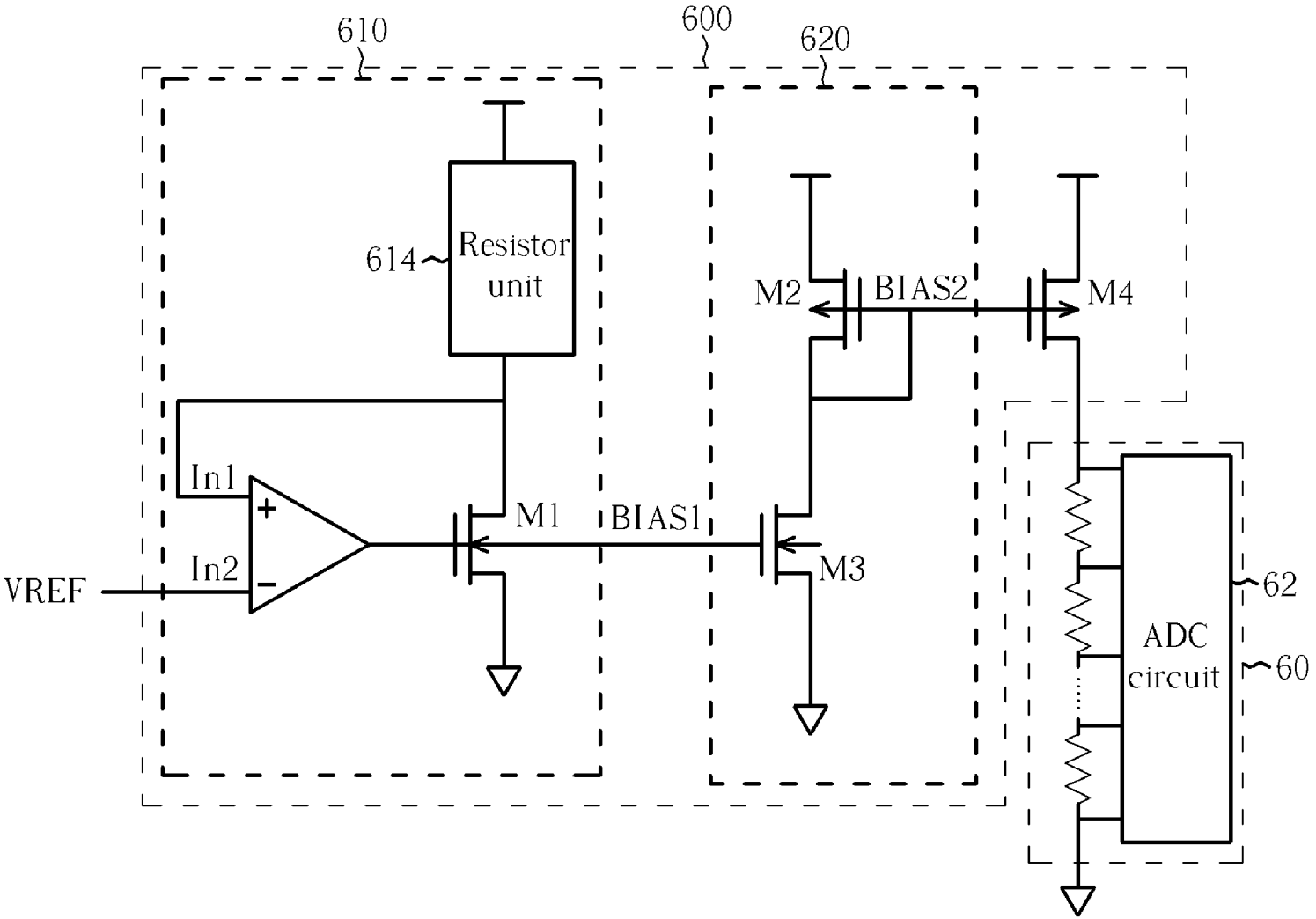

Please refer to FIGS. 4-6, which are schematic diagrams of reference voltage generators 400, 500 and 600 for ADC circuits 42, 52 and 62 according to embodiments of the present invention. In FIG. 4, the architecture and operating principle of the reference voltage generator 400 are similar to those of the reference voltage generator 300. The difference is that the transistors M1 and M6 are implemented with n-type MOSFETs instead of p-type MOSFETs. In addition, the bias converter 420 receives the first bias voltage BIAS1 through the transistor M3, and absorbs kickback noise coming from the load circuit 40 with the transistor M5, so as to protect the bias generator 410 and the reference voltage VREF. As for FIG. 5, the bias generator 510 is identical with the bias generator 310 in FIG. 3, whereas the bias converter 520 is the branch of the transistors M2 and M3 in the bias converter 320. The bias converter 520 utilizes the transistor M2 to receive the first bias voltage BIAS1 outputted by the bias generator 510 and the transistor M3 to output the second bias voltage BIAS2. In FIG. 6, the bias generator 610 is identical with the bias generator 410 in FIG. 4, whereas the bias converter 620 is the branch of the transistors M2 and M3 in the bias converter 320. The bias converter 620 utilizes the transistor M3 to receive the first bias voltage BIAS1 outputted by the bias generator 610 and the transistor M2 to output the second bias voltage BIAS2. The transistor M6 outputs voltage to the load circuit 60 in accordance with the second bias voltage BIAS2. As mentioned above, the reference voltage generators 500 and 600 employ half of the current mirror circuit. The transistors M3 and M2 are responsible for absorption of kickback noise from the load circuits 50 and 60. The noise resistance performance in the reference voltage generators 500 and 600 might not be as obvious as that in the reference voltage generators 300 and 400, but the production cost is lower.

In conclusion, the reference voltage generator of the present invention employs a bias converter, preferably a current mirror, to absorb the kickback noise generated by the load circuit. The reference voltage generator protects the bias generator and the reference voltage from signal disturbance, and helps rapid recovery to a stable state. Therefore, the reference voltage generator in the present invention extends the operating bandwidth of the amplifier and achieves small area, low cost, and high efficiency.

Those skilled in the art will readily observe that numerous modifications and alterations of the device and method may be made while retaining the teachings of the invention.

What is claimed is:

1. A reference voltage generator for an analog-to-digital converter circuit, the reference voltage generator comprising:

a bias generator for generating a first bias voltage in accordance with a reference voltage, the bias generator comprising:

a first transistor having a first terminal, a second terminal and a third terminal;

an amplifier comprising a first input terminal for receiving the reference voltage, a second input terminal coupled to the third terminal of the first transistor, an output terminal coupled to the second terminal of the first transistor and the bias converter, the amplifier used for outputting the first bias voltage with the output terminal in accordance with the reference voltage received by the first input terminal; and a resistor unit coupled to the third terminal of the first transistor;

a bias converter coupled to the bias generator, for converting the first bias voltage to a second bias voltage, wherein the bias converter is a current mirror branch and comprises:

a second transistor having a source, a drain and a gate coupled to the bias generator, the gate of the second transistor used for receiving the first bias voltage; and a third transistor having a source, a drain coupled to the drain of the second transistor, and a gate coupled to the drain and the output unit, the gate of the third transistor used for outputting the second bias voltage; and an output unit coupled to the bias converter, for providing a first voltage to a load circuit in accordance with the second bias voltage, the load circuit being impedance-matched with the resistor unit, wherein the output unit is a p-type metal oxide semiconductor transistor that has a source coupled to a power, a gate coupled to the bias converter, and a drain coupled to the load circuit.

2. The reference voltage generator of claim 1, wherein the first transistor is a p-type metal oxide semiconductor transistor, the first terminal of the first transistor is a source, the second terminal of the first transistor is a gate, and the third terminal of the first transistor is a drain.

3. The reference voltage generator of claim 1, wherein the first transistor is an n-type metal oxide semiconductor transistor, the first terminal of the first transistor is a source, the second terminal of the first transistor is a gate, and the third terminal of the first transistor is a drain.

4. A reference voltage generator for an analog-to-digital converter circuit, the reference voltage generator comprising:

a bias generator for generating a first bias voltage in accordance with a reference voltage, the bias generator comprising:

a first transistor having a first terminal, a second terminal and a third terminal;

an amplifier comprising a first input terminal for receiving the reference voltage, a second input terminal coupled to the third terminal of the first transistor, an output terminal coupled to the second terminal of the first transistor and the bias converter, the amplifier used for outputting the first bias voltage with the output terminal in accordance with the reference voltage received by the first input terminal; and a resistor unit coupled to the third terminal of the first transistor;

a bias converter coupled to the bias generator, for converting the first bias voltage to a second bias voltage, wherein the bias converter is a current mirror branch and comprises:

a second transistor having a source, a drain and a gate coupled to the drain and the output unit, the gate of the second transistor used for outputting the second bias voltage; and a third transistor having a source, a drain coupled to the drain of the second transistor, and a gate coupled to the bias generator, the gate of the third transistor used for receiving the first bias voltage; and an output unit coupled to the bias converter, for providing a first voltage to a load circuit in accordance with the second bias voltage, the load circuit being impedance-matched with the resistor unit, wherein the output unit is a p-type metal oxide semiconductor transistor that has a source coupled to a power, a gate coupled to the bias converter, and a drain coupled to the load circuit.

5. The reference voltage generator of claim 4, wherein the first transistor is a p-type metal oxide semiconductor transistor, the first terminal of the first transistor is a source, the second terminal of the first transistor is a gate, and the third terminal of the first transistor is a drain.

6. The reference voltage generator of claim 4, wherein the first transistor is an n-type metal oxide semiconductor transistor, the first terminal of the first transistor is a source, the second terminal of the first transistor is a gate, and the third terminal of the first transistor is a drain.

7. A reference voltage generator for an analog-to-digital converter circuit, the reference voltage generator comprising:

a bias generator for generating a first bias voltage in accordance with a reference voltage, the bias generator comprising:

a first transistor having a first terminal, a second terminal and a third terminal;

an amplifier comprising a first input terminal for receiving the reference voltage, a second input terminal coupled to the third terminal of the first transistor, an output terminal coupled to the second terminal of the first transistor and the bias converter, the amplifier used for outputting the first bias voltage with the output terminal in accordance with the reference voltage received by the first input terminal; and a resistor unit coupled to the third terminal of the first transistor;

a bias converter coupled to the bias generator, for converting the first bias voltage to a second bias voltage, wherein the bias converter is a current mirror branch and comprises:

a second transistor having a source, a drain and a gate coupled to the bias generator, the gate of the second transistor used for receiving the first bias voltage; and a third transistor having a source, a drain coupled to the drain of the second transistor, and a gate coupled to the drain and the output unit, the gate of the third transistor used for outputting the second bias voltage; and an output unit coupled to the bias converter, for providing a first voltage to a load circuit in accordance with the second bias voltage, the load circuit being impedance-matched with the resistor unit, wherein the output unit is an n-type metal oxide semiconductor transistor that has a source coupled to a ground, a gate coupled to the bias converter, and a drain coupled to the load circuit.

8. A reference voltage generator for an analog-to-digital converter circuit, the reference voltage generator comprising:

a bias generator for generating a first bias voltage in accordance with a reference voltage, the bias generator comprising:

a first transistor having a first terminal, a second terminal and a third terminal;

an amplifier comprising a first input terminal for receiving the reference voltage, a second input terminal coupled to the third terminal of the first transistor, an output terminal coupled to the second terminal of the first transistor and the bias converter, the amplifier used for outputting the first bias voltage with the output terminal in accordance with the reference voltage received by the first input terminal; and a resistor unit coupled to the third terminal of the first transistor;

a bias converter coupled to the bias generator, for converting the first bias voltage to a second bias voltage, wherein the bias converter is a current mirror branch and comprises:

a second transistor having a source, a drain and a gate coupled to the drain and the output unit, the gate of the second transistor used for outputting the second bias voltage; and a third transistor having a source, a drain coupled to the drain of the second transistor, and a gate coupled to the bias generator, the gate of the third transistor used for receiving the first bias voltage; and an output unit coupled to the bias converter, for providing a first voltage to a load circuit in accordance with the second bias voltage, the load circuit being impedance-matched with the resistor unit, wherein the output unit is an n-type metal oxide semiconductor transistor that has a source coupled to a ground, a gate coupled to the bias converter, and a drain coupled to the load circuit.

* * * * *